United States Patent [19]

Stanfill

[11] Patent Number: 4,730,463

[45] Date of Patent: Mar. 15, 1988

[54] BEVERAGE DISPENSER COOLING SYSTEM

[76] Inventor: Ted M. Stanfill, 3104 Bellaire Dr. West, Fort Worth, Tex. 76109

[21] Appl. No.: 859,790

[22] Filed: May 5, 1986

[51] Int. Cl.[4] ..... B67D 5/62

[52] U.S. Cl. ..... 62/399; 62/396; 62/389; 222/146.6

[58] Field of Search ..... 62/389, 7, 430, 222, 62/393, 396, 399, 98, 99, 394; 222/1, 146.1, 394, 146.6

[56] References Cited

U.S. PATENT DOCUMENTS 2,039,556 5/1936 Ruse .
2,248,637 7/1941 McLaughlin .
2,598,751 6/1952 Berkowitz et al. .
2,653,014 9/1953 Sniader .
3,180,108 4/1965 Rhodes .
4,094,445 6/1978 Bevan .

*Primary Examiner*—Henry Bennett
*Attorney, Agent, or Firm*—James E. Bradley

[57] ABSTRACT

A beverage dispensing system further cools the beverage where it is dispensed at a considerable distance from the beverage storage container. The beverage conduit between the storage and dispensing sites is carried in a bundle located within an insulated jacket conduit. The bundle also contains parallel chilled liquid lines through which chilled liquid is circulated. A concentric coil is located at the dispensing site. A manifold connects the parallel beverage and chilled liquid lines to the concentric coil and to the dispensing valve.

6 Claims, 2 Drawing Figures

BEVERAGE DISPENSER COOLING SYSTEM

BACKGROUND OF THE INVENTION

1. Field of the Invention:

This invention relates in general to dispensing cold beverages from a tap, and in particular to an additional cooling unit used to reduce the temperature of the beverage at the tap.

2. Description of the Prior Art:

In restaurants, bars, stadiums and other public facilities, soft drinks and beer are commonly dispensed on tap. In many cases, the supply containers, such as the beer kegs, will be located in a large walk-in cooler or refrigerator. The drinks may be dispensed at several locations considerable distances away from the supply containers, as much as up to five hundred feet.

In the case of beer, this is handled by connecting the beer keg to a carbon dioxide container, which applies pressure to a beer line leading to the valve or tap. To keep the temperature of the beer in the beer line from warming too much, a chilled liquid line containing glycol runs in parallel alongside the beer line. The glycol line and the various beer lines are all located in a parallel bundle surrounded by an insulated jacket conduit. The glycol is kept at a cool temperature by a glycol refrigeration unit which cools the glycol in a glycol tank located near the beer kegs.

In the case of soft drinks, where no beer is being served, carbonated water will be circulated through a chilled liquid line in the parallel bundle instead of glycol. The carbonated water is mixed at the dispensing site with the soft drink syrup.

While these systems are successful, warming of the beverage is still a problem. The parallel chilled liquid lines do not adequately maintain the temperature of the beverage in some cases where the lines are very long. This can be partiuclarly a problem with beer. If the temperature goes above approximately 40–45 degrees Fahrenheit, the beer will foam excessively at the tap.

SUMMARY OF THE INVENTION

In this invention, the conventional parallel lines are still used, with glycol or carbonated water being circulated in parallel lines through the bundle containing the beverage lines. An insulated concentric coil is located at the dispensing site. The insulated concentric coil has an inner conduit concentrically located inside an outer conduit. A manifold fitting connects the transmit and return chilled lines to opposite ends of one of the concentric conduits. A manifold fitting also connects the beverage conduit and the valve line to opposite ends of the other concentric conduit.

In this manner, the flow through parallel lines is converted into flow through a concentric coil, with the beverage contained in one of the concentric conduits and the chilled liquid in the other concentric conduit. The heat exchange in the concentric coil is better than in a parallel arrangement, further cooling the beverage at the dispensing site.

DESCRIPTION OF THE PREFERRED EMBODIMENT

Figure 1:
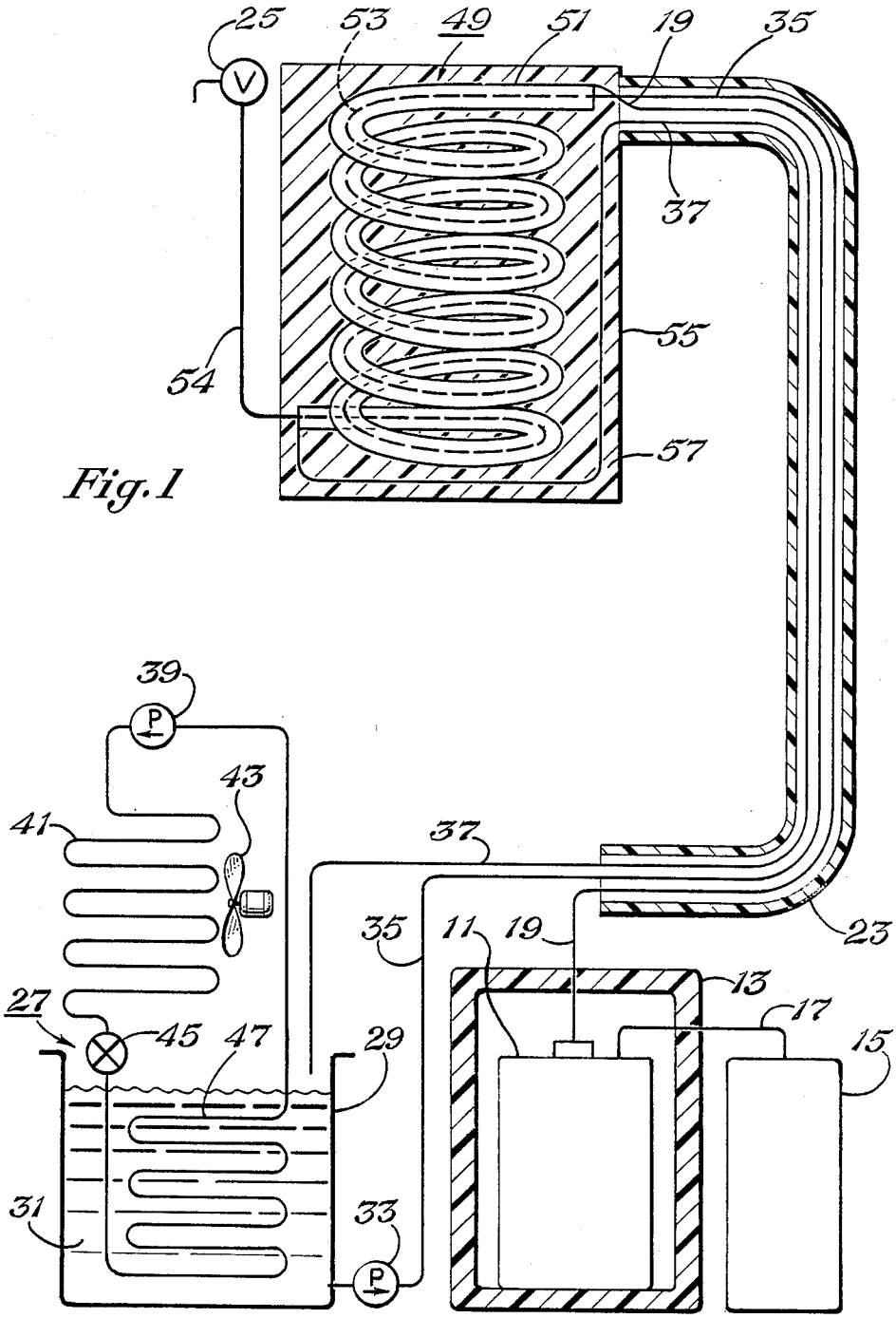
FIG. 1 is a schematic illustrating a beverage dispensing cooling system constructed in accordance with this invention.

FIG. 1 shows a beverage dispenser cooling system particularly for use in dispensing beer on tap. The system includes a storage container such as a beer keg 11 containing beer. The keg 11 will typically be located within a refrigerated unit 13, such as a large walk-in refrigerator. A carbon dioxide tank 15 is connected to the interior of the keg 11 for applying pressure to the beer contained therein. The contents of the beer keg 11 are connected to a beverage or beer line 19. Beer line 19 extends into an insulated jacket conduit 23, which leads eventually to the site of a valve or tap 25. The distance from the refrigerator 13 to the tap 25 can be quite far, with conduit 23 extending up to five hundred feet.

To prevent the beer in the beer line 19 from warming excessively, a glycol unit 27 is used. Glycol unit 27 is a conventional assembly, having a glycol tank 29. Tank 29 holds a chilled liquid such as glycol 31. The glycol is pumped from the tank 29 by a pump 33. Pump 33 is connected to a glycol transmit line 35 which extends through the insulated jacket conduit 23 in parallel with the beer line 19. The glycol 31 is returned in a glycol return line 37, which also extends in parallel through the insulated jacket conduit 23. The beer line 19 and the glycol lines 35 and 37 are normally of a polyethylene.

The glycol 31 is maintained in its chilled condition by means of a conventional refrigeration system including a compressor 39. Compressor 39 pumps gaseous refrigerant such as freon through a condenser 41. The refrigerant condenses into a liquid in the condenser 41, caused by the cooling from a fan 43. The liquid refrigerant flows through an expansion valve 45 where it expands into a cold gas. The cold gas flows through an evaporator 47, cooling the coils of the evaporator 47. Evaporator coils 47 are located in the glycol tank 29 for cooling the glycol 31. The refrigerant from the evaporator 47 returns to the compressor 39.

To further enhance cooling of the beer in the beer line 19 at the tap 25, a concentric coil 49 is located at the dispensing site. Concentric coil 49 includes an outer conduit 51 which normally is of a plastic such as polyethylene. An inner conduit 53 is carried concentrically inside the outer conduit 51. The inner conduit 53 is of stainless steel. The outer conduit 51 is connected on one end to the glycol transmit line 35 and on the other end to the glycol return line 37. The inner conduit 53 is connected on one end to the beer line 19. The other end of the inner conduit 53 is connected to the valve or tap line 54. The tap line 54 is typically only two or three feet in length and leads to the tap 25. The length of the concentric coil 49 is preferably from about fifteen feet to twenty-five feet.

Figure 2:
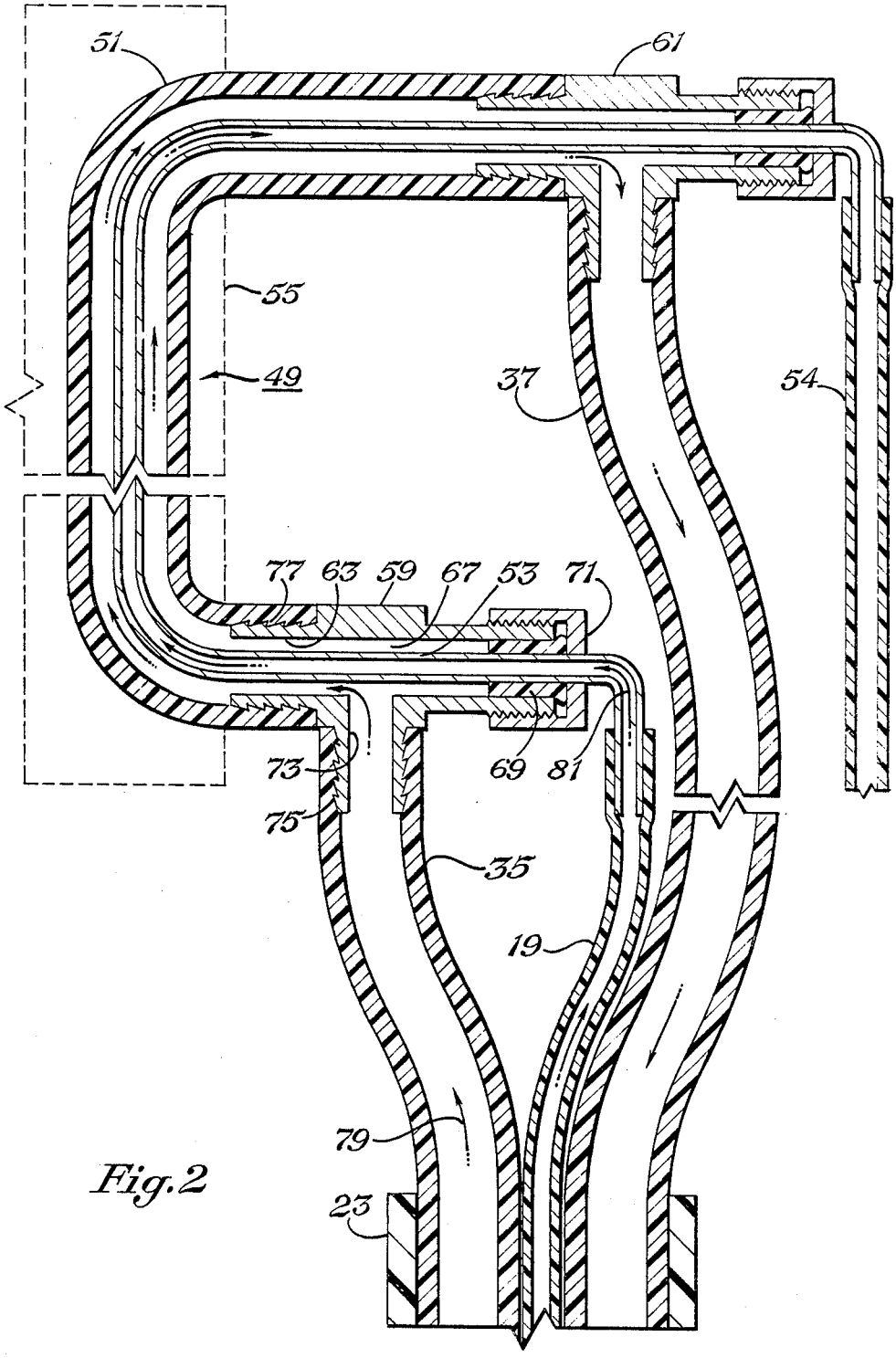
FIG. 2 is a partial enlarged view showing the manifold fittings for the cooling system in FIG. 1.

The concentric coil 49 is carried inside a box 55. Box 55 is filled with an insulation foam 57. FIG. 2 shows a preferred embodiment for the manifold means for connecting the concentric coil 49 to the lines 19, 35, 37 and 54. The manifold means includes two fittings 59 and 61. Each fitting 59 and 61 is identical and comprises a tubular member. Each fitting 59, 61 has an axial passage 63 extending through it. The inner conduit 53 extends axially through passage 63 and protrudes out each end. This defines an annular space 67 in the passage 63 that surrounds the inner conduit 53. A seal 69 is located on the outer end of each passage 63. Seal 69 is an elastomeric seal compressed between the inner conduit 53 and the walls of the passage 63. A retainer nut 71 is secured to the outer end of each fitting 59, 61 for compressing the seal 69. As previously mentioned, one end of the inner conduit 53 is connected to the beer line 19. The other end of the inner conduit 53 is connected to the tap line 54.

A port 73 extends through the sidewall of each fitting 59, 61 perpendicular to the passage 63. Port 73 communicates with the annular space 67. A tubular nipple 75 extends outwardly from the port 73. Nipple 75 for the fitting 59 receives the glycol transmit line 35. Nipple 75 for fitting 61 receives the glycol return line 37. A nipple 77 is also formed on the end of each fitting 59, 61 opposite the seal 69. Nipple 77 receives the outer conduit 51 of the concentric coil 49.

In operation, the glycol unit 27 will chill the glycol 31 to maintain its temperature at approximately 28 degrees in the tank 29. Pump 33 will pump the glycol through the glycol transmit line 35. As shown in FIG. 2 by arrows 79, the glycol flows through the port 73, through the annular space 67 and through the outer conduit 51 of the concentric coil 49. The glycol exits the fitting 61 and flows back into the return glycol line 37, where it subsequently enters the tank 29, shown in FIG. 1.

The close proximity of the chilled glycol lines 35 and 37 in the insulated jacket conduit 23 prevents the beer in line 19 from warming substantially. If the tap 25 is open, the pressure from the carbon dioxide tank 15 will cause the beer to flow from beer keg 11 through beer line 19. As shown by the arrows 81 in FIG. 2, the beer flows into the inner conduit 53 of the concentric coil 49. The beer is further cooled by the heat transfer that takes place between the thin walled stainless steel inner conduit 53 and the glycol flowing through the outer conduit 51.

The beer exits the manifold 61 and flow through the tap line 54 to the valve 25 (FIG. 1). Depending upon the temperature of the beer in keg 11, the concentric coil 49 will maintain the beer temperature as it exits the tap 25 in the range from about 29 degrees to 38 degrees. This is below the range at which beer tends to foam, which is around 40 degrees to 45 degrees. The connections of the inner conduit 53 with the tap line 54 and the beer line 19 are smooth, with little change in flow area so as to reduce turbulence at this point, which can cause foaming.

In the preferred embodiment, the glycol unit 27 will have a capacity of about 25 to 100 gallons per hour. The glycol lines 35 and 37 will be about one-half inch inner diameter. Typically, the beer line 19 has about a $\frac{3}{8}$ inch inner diameter. Preferably, the stainless steel inner conduit 53 has about $\frac{1}{4}$ inch inner diameter, and the beer line 19 will be reduced down from $\frac{3}{8}$ inch to $\frac{1}{4}$ inch by a reducer (not shown) prior to connecting to the inner conduit 53. Typically, the tap line 54 will be about $\frac{1}{4}$ inch in diameter. Often, there will be many more conduits in the insulated jacket conduit than the three conduits shown in the preferred embodiment. Others of the conduits will lead to other dispensing stations, or be used to dispense soft drinks. In some cases, as many as nineteen different lines will be contained in the jacket conduit 23. Although box 55 has been shown containing only one concentric coil 49, a separate concentric coil will be needed for each tap 25. The box 55 may be made to contain more than one concentric coil 49, or several of the boxes 55 may be used.

In a soft drink only system, where beer isn't being dispensed, normally the chilled liquid lines 35 and 37 will be circulating chilled carbonated water rather than glycol. On the other side of the concentric coil 49, in a soft drink installation, mixing valves (not shown) will connect with the carbonated water line for mixing with the syrup flowing through other of the conduits. Carbonated water temperatures are preferably maintain around 33 to 34 degrees so as to prevent the soft drink from being dispensed at more than 40 degrees.

While the invention has been shown in only one of its forms, it should be apparent to those skilled in the art that it is not so limited, but is susceptible to various changes without departing from the scope of the invention.

I claim:

1. In a beverage dispensing system of the type having a supply container of the beverage located at a storage site, valve means at a dispensing site remote from the storage site for dispensing the beverage, pressure means for supplying the beverage under presssure from the supply container to the valve means through a beverage conduit, refrigeration means at the storage site for cooling a liquid into a chilled liquid, pump means at the storage site for circulating the chilled liquid from the storage site to the dispensing site through a transmit chilled line and from the dispensing site back to the storage site through a return chilled line, the chilled lines running in parallel with the beverage conduit within an insulated jacket conduit extending between the storage and dispensing sites, the improvement comprising in combination:

an insulated concentric section located at the dispensing site, having an inner conduit concentrically located within an outer conduit; and manifold means for connecting the transmit and return chilled lines to oposite ends of one of the concentric conduits, and for connecting the beverage conduit and valve means to opposite ends of the other concentric conduit, to further cool the beverage by heat transfer from the chilled liquid in the concentric section.

2. The system according to claim 1 wherein the inner concentric conduit is of stainless steel.

3. In a beverage dispensing system of the type having a supply container of the beverage located at a storage site, valve means at a dispensing site remote from the storage site for dispensing the beverage, pressure means for supplying the beverage under pressure from the supply container to the valve means through a beverage conduit, refrigeration means at the storage site for cooling a liquid into a chilled liquid, pump means at the storage site for circulating the chilled liquid from the storage site to the dispensing site through a transmit chilled line and from the dispensing site back to the storage site through a return chilled line, the chilled lines running in parallel with the beverage conduit within an insulated jacket conduit extending between the storage and dispensing sites, the improvement comprising in combination:

an insulated concentric section located at the dispensing site, having an inner conduit concentrically located within an outer conduit; and manifold means for connecting the transmit and return chilled lines to opposite ends of the outer conduit, and for connecting the beverage conduit and valve means to opposite ends of the inner conduit, to further cool the beverage by heat transfer of the chilled liquid flowing in the outer conduit and immersing the inner conduit.

4. The system according to claim 3 further comprising:

an insulated container for housing the section, the insulated container being filled with insulation material.

5. The system according to claim 3 wherein the section has a length from substantially 15 to 25 feet.

6. The system according to claim 3 wherein each of the manifold means comprises:

a pair of tubular fittings, each having a passage extending therethrough of greater diameter than the outer diameter of the inner conduit for receiving the ends of the inner conduit and defining an annular space surrounding the inner conduit, the inner conduit ends protruding through the passages of the fittings;

seal means at each fitting for sealing the inner conduit to the fitting at the end from which the inner conduit protrudes;

a port in each fitting intersecting the passage and in communication with the annular space;

each of the fittings having a nipple on the end opposite the seal means to which ends of the outer conduit are secured, communicating the annular space with the outer conduit; and each of the fittings having a nipple on the port to which the chilled liquid conduit ends are secured.

* * * * *